US007941252B2

(12) United States Patent
Medema et al.

(10) Patent No.: US 7,941,252 B2
(45) Date of Patent: May 10, 2011

(54) SYSTEM, METHOD AND COMPUTER READABLE MEDIA FOR CONTROLLING AUTOMATIC STARTS AND AUTOMATIC STOPS OF A LOCOMOTIVE ENGINE

(75) Inventors: Timothy J. Medema, Algonquin, IL (US); Soban Jalil, Erie, PA (US); Mikhail Meltser, Buffalo Grove, IL (US)

(73) Assignee: General Electric Company, Schenectady, NY (US)

( * ) Notice: Subject to any disclaimer, the term of this patent is extended or adjusted under 35 U.S.C. 154(b) by 1131 days.

(21) Appl. No.: 11/619,652

(22) Filed: Jan. 4, 2007

(65) Prior Publication Data

US 2008/0167765 A1 Jul. 10, 2008

(51) Int. Cl.

| | |
|---|---|
| ***G05D 1/00*** | (2006.01) |
| *G06F 19/00* | (2006.01) |
| *G08G 1/00* | (2006.01) |
| *B61L 3/00* | (2006.01) |
| *F02D 41/06* | (2006.01) |

(52) U.S. Cl. ..... 701/19; 701/112; 701/114; 701/115; 701/117; 246/182 R; 246/167; 123/179.16; 123/179.36

(58) Field of Classification Search ..... 701/19, 701/112, 114, 115, 117; 246/167, 182; 123/179.36, 123/179.16

See application file for complete search history.

(56) References Cited

U.S. PATENT DOCUMENTS

| | | | | |
|---|---|---|---|---|
| 5,828,979 | A * | 10/1998 | Polivka et al. | 701/117 |
| 6,650,993 | B2 * | 11/2003 | Wolf et al. | 701/112 |
| 6,671,591 | B2 * | 12/2003 | Wolf et al. | 701/19 |
| 6,810,718 | B2 * | 11/2004 | Wilson et al. | 73/54.01 |
| 6,941,218 | B2 | 9/2005 | Wolf et al. | |
| 7,200,471 | B2 * | 4/2007 | Kane et al. | 701/19 |
| 7,500,458 | B2 * | 3/2009 | Juenemann et al. | 123/179.3 |
| 2004/0007405 | A1 * | 1/2004 | Noda et al. | 180/65.4 |
| 2004/0079257 | A1 * | 4/2004 | Scott Tidmarsh | 104/156 |
| 2007/0078040 | A1 * | 4/2007 | Nobumoto et al. | 477/70 |
| 2007/0095322 | A1 * | 5/2007 | Mizutani | 123/179.16 |
| 2008/0082247 | A1 * | 4/2008 | Hawkins et al. | 701/101 |

* cited by examiner

*Primary Examiner* — Khoi Tran
*Assistant Examiner* — Ian Jen
(74) *Attorney, Agent, or Firm* — Robert Wawrzyn, Esq.; Cian G. O'Brien, Esq.; Beusse Wolter Sanks Mora & Maire, P.A.

(57) ABSTRACT

A convertible system is provided for controlling automatic starts and automatic stops of a locomotive engine. The convertible system is switchable between a yard mode and a road mode based upon respectively using the locomotive in one of a yard region and road region. The convertible system includes a pressure sensor to sense pressure supplied to a brake system. More particularly, the convertible system includes a microprocessor coupled to the pressure sensor. The microprocessor causes one of an automatic start and automatic stop by sending a respective start up signal or a shut down signal to the locomotive engine, based on comparing the pressure supplied to the brake system with a stored pressure threshold for each of the yard mode and road mode.

17 Claims, 8 Drawing Sheets

| Parameter | Configurable/ Hard Coded | UOM | Yard | Road |
|---|---|---|---|---|
| Time between crank attempts | H | Min. | 2 | 2 |
| Number of crank attempts allowed in a row | H | – | 3 | 3 |
| Maximum crank time allowed per attempt | H | Sec. | 20 | 20 |
| Minimum priming time per attempt | C | Sec. | 60 | 60 |
| Time before load shed activated | H | Min. | 15 | 15 |
| Warning bell alert before cranking | H | Sec. | 30 | 30 |
| Interval between warning bell rings during auto stop | H | Min. | 5 | 5 |
| Warning bell ring duration during auto stop | H | Sec. | 1 | 1 |
| Default idle time required before auto shutdown | C | Min. | 15 | 15 |
| Long time before auto shutdown (ASO switch) | C | Min. | 120 | 120 |
| Short time before auto shutdown (test switch) | H | Min. | 1 | 1 |
| ESR1 dropout delay (WAP running) | C | Sec. | 300 | 300 |
| Minimum battery voltage to allow one buttom start | H | V | 58 | 58 |
| Minimum battery voltage to cause auto start | H | V | 62 | 62 |
| Minimum battery voltage to permit auto stop | H | V | 66 | 66 |
| Maximum battery voltage to permit auto stop | H | V | 80 | 80 |
| Maximum battery current to permit auto stop | H | A | 100 | 100 |
| Minimum battery current to permit auto stop | C | A | 0.2 | 0.2 |
| Maximum ambient air temperature to cause auto start | C | °F | 180 | 180 |
| Minimum ambient air temperature to cause auto start | C | °F | 32 | 32 |
| Maximum ambient air temperature to permit auto stop | H | °F | 110 | 110 |
| Minimum ambient air temperature to permit auto stop | H | °F | 120 | 120 |
| Minimum engine water temperature to cause auto start | C | °F | 32 | 32 |
| Maximum engine water temperature to permit auto stop | H | °F | 110 | 110 |
| Minimum engine water temperature to permit auto stop | C | °F | 35 | 35 |
| Minimum brake cylinder pressure to cause auto start (YARD) | C | PSI | 45 | |
| Minimum brake cylinder pressure to allow auto stop (YARD) | C | PSI | 55 | |
| Minimum MR1 pressure to permit auto stop (ROAD) | C | PSI | | 125 |
| Minimum MR1 pressure to cause auto start (ROAD) | C | PSI | | 105 |
| Maximum MR1 pressure to allow auto stop (ROAD) | H | PSI | | 150 |
| Maximum duration of an auto stop | C | Min. | | 210 |
| Maximum number of auto stops allowed per 24 hour period | C | – | | 8 |

*FIG. 8*

SYSTEM, METHOD AND COMPUTER READABLE MEDIA FOR CONTROLLING AUTOMATIC STARTS AND AUTOMATIC STOPS OF A LOCOMOTIVE ENGINE

FIELD OF THE INVENTION

The present invention relates to locomotives, and more particularly, to a system, method and computer readable media for controlling automatic starts and automatic stops of a locomotive engine.

BACKGROUND OF THE INVENTION

Locomotives are typically used in one of a yard region or a road region. For example, a locomotive may be used in a yard region for moving cars from one locomotive to another locomotive, while a locomotive may be used in a road region to haul freight. The FRA (Federal Railroad Administration) and AAR (Association of American Railroads) regulate conditions of a locomotive in each of the yard region and road region to ensure the locomotive conditions do not violate respective yard restrictions and road restrictions in each respective yard region and road region.

Presently, locomotives operating the yard region are installed with a yard system to monitor locomotive conditions in the yard region and ensure compliance with the FRA/AAR yard regulations. Similarly, locomotives operating in the road region are installed with a road system to monitor locomotive conditions in the road region and ensure compliance with the FRA/MR road regulations. As neither of the yard system or road system may be used in both of the yard region and road region, each system must be uninstalled and a new system installed when the locomotive operates in a new region. Accordingly, it would be advantageous, in terms of time efficiency and cost efficiency, to provide a single system capable of monitoring the locomotive conditions in both the yard region and the road region for ensuring compliance with the FRA/AR regulations.

BRIEF DESCRIPTION OF THE INVENTION

In one embodiment of the present invention, a convertible system is provided for controlling automatic starts and automatic stops of a locomotive engine. The locomotive is used in one of a yard region and road region. The convertible system is switchable between a yard mode and a road mode based on respectively using the locomotive in the yard region and the road region. The convertible system includes pressure sensors to sense respective pressure supplied to a locomotive brake system and a locomotive and train combination brake system. More particularly, the convertible system includes a microprocessor coupled to each pressure sensor, each respective brake system and a locomotive engine. The microprocessor causes an automatic start or automatic stop of the locomotive engine based on sending a respective start up signal or shut down signal to the locomotive engine. Each respective start up signal and shut down signal is based on comparing the pressure supplied to a brake system received from a pressure sensor with a plurality of stored pressure thresholds for each yard mode and road mode, and is further based on comparing time-related data for the automatic stops during the road mode with a plurality of road mode thresholds.

In another embodiment of the present invention, a method is provided for controlling automatic starts and automatic stops of a locomotive engine. The locomotive is used in one of a yard region and road region. The method is switchable between a yard mode and a road mode based on respectively using the locomotive in the yard region and the road region. The method includes sensing a pressure respectively supplied to a locomotive brake system and a locomotive and train combination brake system. Additionally, the method includes comparing the pressure supplied to each brake system with a plurality of stored pressure thresholds for each yard mode and road mode. More particularly, the method includes comparing time-related data for the automatic stops during the road mode with a plurality of road mode thresholds. The method further includes sending a respective start up signal or shut down signal to a locomotive engine, based on comparing the pressure supplied to each brake system with the plurality of stored pressure thresholds and comparing time-related data for the automatic stops during the road mode with the plurality of road mode thresholds. The method further includes causing an automatic start or an automatic stop based on sending a respective start up signal and a shut down signal to the locomotive engine.

In another embodiment of the present invention, a computer readable media containing program instructions is provided for a method for controlling automatic starts and automatic stops of a locomotive engine. The locomotive is used in one of a yard region and road region. The method is switchable between a yard mode and a road mode based on respectively using the locomotive in the yard region and the road region. The method includes sensing pressure respectively supplied to a locomotive brake system and a locomotive and train combination brake system. The computer readable media includes a computer program code to compare the pressure supplied to each brake system with a plurality of stored pressure thresholds for each yard mode and road mode. Additionally, the computer readable media includes a computer program code to compare time-related data for the automatic stops during the road mode with a plurality of road mode thresholds. More particularly, the computer readable media includes a computer program code to send a start up signal or shut down signal to a locomotive engine, based on the computer program code to compare the pressure supplied to each brake system with a plurality of stored pressure thresholds and the computer program code to compare time-related data for the automatic stops during the road mode with a plurality of road mode thresholds. The computer readable media further includes a computer program code to cause an automatic start or automatic stop based on the computer program code to send a respective start up signal or shut down signal to a locomotive engine.

BRIEF DESCRIPTION OF THE DRAWINGS

A more particular description of the invention briefly described above will be rendered by reference to specific embodiments thereof that are illustrated in the appended drawings. Understanding that these drawings depict only typical embodiments of the invention and are not therefore to be considered to be limiting of its scope, these embodiments of the invention will be described and explained with additional specificity and detail through the use of the accompanying drawings in which:

FIG. 8 is a table of pressure thresholds for an exemplary embodiment of the present invention.

DETAILED DESCRIPTION OF THE INVENTION

Figure 1:
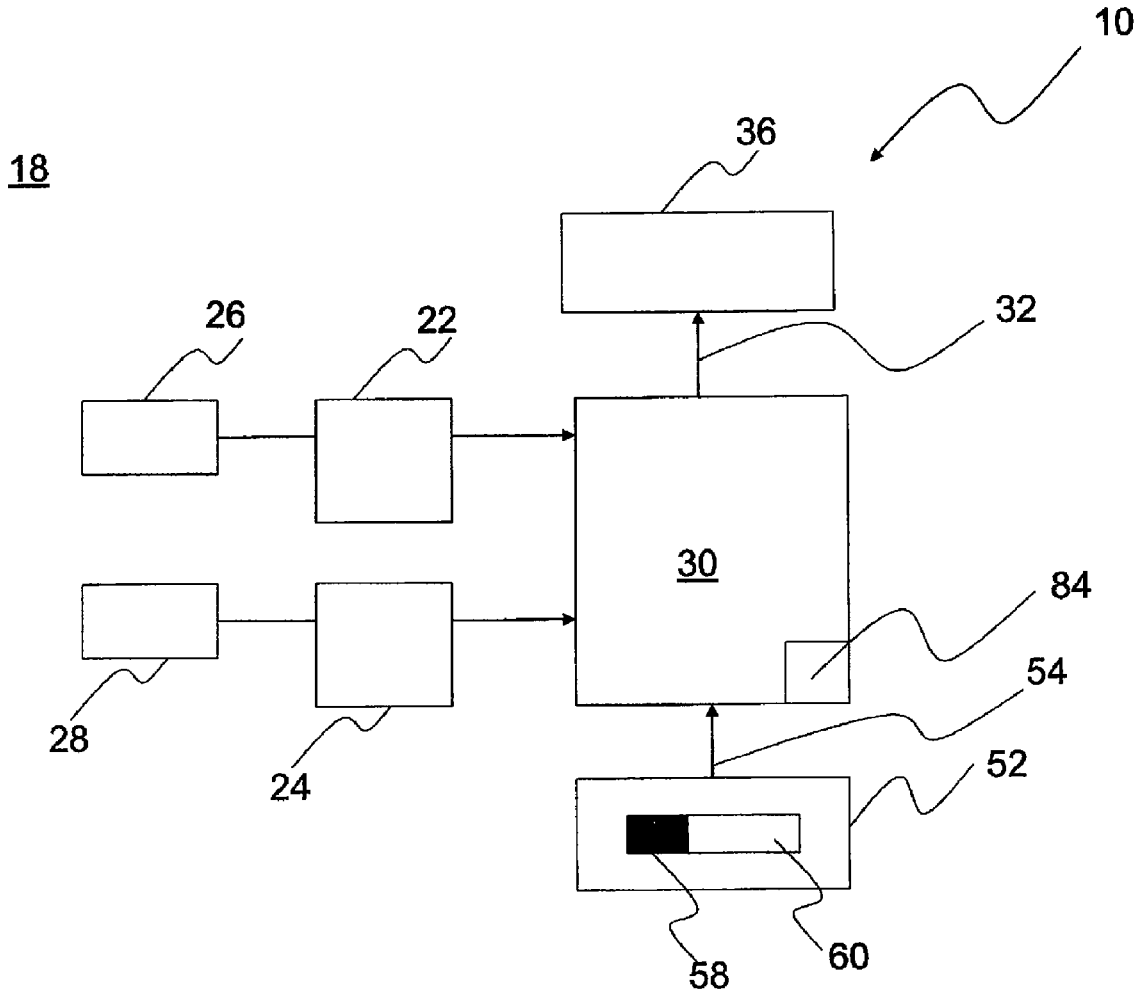
FIG. 1 is a schematic diagram of one embodiment of a convertible system in a yard mode.

FIG. 1 illustrates one embodiment of a convertible system 10 for controlling automatic starts and automatic stops of a locomotive engine 36. The locomotive 12 may be used in a yard region 14 (FIG. 3) or a road region 16 (FIG. 4). The convertible system 10 is switchable between a yard mode 18 (FIG. 1) and a road mode 20 (FIG. 2) based on respectively using the locomotive 12 in the yard region 14 and the road region 16.

Figure 2:
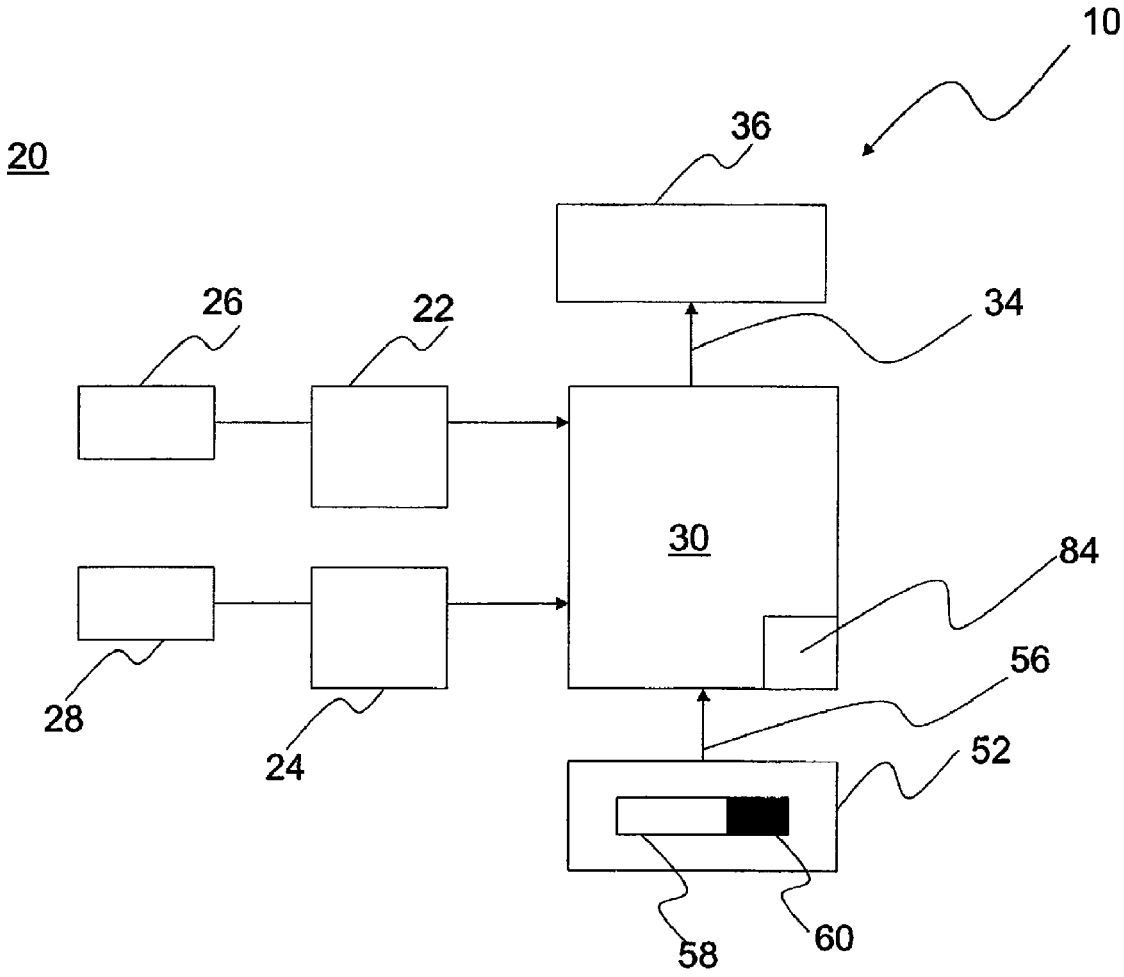
FIG. 2 is a schematic diagram of the convertible system of FIG. 1 in a road mode.

The convertible system 10 illustratively includes pressure sensors 22,24 to sense respective pressure supplied to a locomotive brake system 26 and a locomotive and train combination brake system 28. Additionally, as shown in FIGS. 1 and 2, the convertible system 10 includes a microprocessor 30 coupled to each pressure sensor 22,24, each respective brake system 26,28, and a locomotive engine 36. The microprocessor 30 causes an automatic start and automatic stop of the locomotive engine 36 based on sending a respective start up signal 32 (FIG. 1) or a shut down signal 34 (FIG. 2) to the locomotive engine 36. Accordingly, FIG. 1 illustrates an embodiment of the convertible system 10 in the yard mode 18 in which the locomotive engine 36 automatically starts based on the start up signal 32 from the microprocessor 30 to the locomotive engine 36. FIG. 2 illustrates an embodiment of the convertible system 10 in the road mode 20 in which the locomotive engine 36 automatically stops based on the shut down signal 34 from the microprocessor 30 to the locomotive engine 36.

Each respective start up signal 32 and shut down signal 34 is based on the microprocessor 30 comparing the pressure received from each respective pressure sensor 22,24 and supplied to each brake system 26,28 with a plurality of stored pressure thresholds for each of the yard mode 18 and the road mode 20. Each respective start up signal 32 and shut down signal 34 is further based on the microprocessor 30 comparing time-related data for the automatic stops during the road mode 20 with a plurality of road mode thresholds. The microprocessor may include an internal counter and such time-related data includes the duration of each automatic stop in the road mode, as well as the number of automatic stops in the road mode within a twenty-four hour period, or any configurable time period. Other types of time-related data may be captured, particularly based on the various types of road mode thresholds, as discussed below. The plurality of pressure sensors 22,24 include a first pressure sensor 22 to sense a first pressure supplied to a locomotive brake system 26, and a second pressure sensor 24 to sense a second pressure supplied to a locomotive and train combination brake system 28. In an exemplary embodiment, the second pressure supplied to the locomotive and train combination brake system 28 may be sensed from a main reservoir (ie. MR) of the locomotive, as appreciated by one of skill in the art.

As shown in FIGS. 1 and 2, the illustrated embodiment of a convertible system 10 further includes a manual switch 52 coupled to the microprocessor 30 to respectively switch the convertible system 10 between the yard mode 18 (FIG. 1) and the road mode 20 (FIG. 2). As illustrated in FIGS. 1 and 2, the microprocessor 30 is responsive to a yard signal 54 (FIG. 1) or a road signal 56 (FIG. 2) from the manual switch 52 based on the manual switch moving to a respective yard position 58 (FIG. 1) and a road position 60 (FIG. 2). As discussed below, other embodiments of the convertible system include other types of switches to switch the convertible system between the yard mode and road mode.

Upon receiving the yard signal 54, the microprocessor 30 compares the first pressure of the locomotive brake system 26 with a plurality of yard pressure thresholds of the stored pressure thresholds. Upon receiving the road signal, the microprocessor compares the second pressure of the locomotive and train combination brake system 28 with a plurality of road pressure thresholds of the stored pressure thresholds. The plurality of yard pressure thresholds and road pressure thresholds include a minimum automatic stop threshold, a minimum automatic start threshold, and may include a maximum automatic stop threshold. The minimum automatic stop threshold is the pressure threshold above which the convertible system 10 sends a shut down signal 34 to cause an automatic stop (barring any road mode exception, see below). The minimum automatic start threshold is the pressure threshold below which the convertible system 10 sends a start-up signal 32 to cause an automatic start. The maximum automatic stop threshold is the pressure threshold greater than the maximum operating pressure of the brake system, and thus is not reached under normal conditions.

The plurality of road mode thresholds include a maximum time duration threshold for each automatic stop in the road mode 20 and a maximum number of automatic stops threshold within a predetermined time in the road mode 20. Other road mode thresholds may be used to regulate the automatic stops during the road mode. In an exemplary embodiment of the convertible system, the minimum automatic stop threshold of the yard pressure thresholds is 55 PSI, and the minimum automatic start threshold of the yard pressure thresholds is 45 PSI, for example. In a further exemplary embodiment of the convertible system, the maximum automatic stop threshold for the road pressure thresholds is 150 PSI, the minimum automatic stop threshold of the road pressure thresholds is 125 PSI, the minimum automatic start threshold of the road pressure thresholds is 105 PSI, the maximum time duration threshold for each automatic stop of the road mode thresholds is 210 minutes, and the maximum number of automatic stops threshold within a predetermined time of the road mode thresholds is eight stops within a twenty-four hour period, for example. The predetermined time within which the maximum number of automatic stops occurs is configurable, after which the locomotive operator may enter the maximum number of automatic stops within the configured predetermined time. The automatic stop thresholds for the yard mode and road mode, in addition to the road mode thresholds may vary based upon the particular locomotive design and configuration.

Upon receiving the yard signal 54, the microprocessor 30 initiates the shut down signal 34 to the locomotive engine 36 when the first pressure is greater than the minimum automatic stop threshold of the yard pressure thresholds. As illustrated in FIG. 1, the microprocessor 30 further initiates the startup signal 32 to the locomotive engine 36 when the first pressure is less than the minimum automatic start threshold of the yard pressure thresholds.

As illustrated in FIG. 2, upon receiving the road signal 56, the microprocessor 30 initiates the shut down signal 34 to the locomotive engine 36 when the second pressure is greater than the minimum automatic stop threshold of the road pressure thresholds, unless the maximum number of automatic stops within a predetermined time threshold of the road mode thresholds has been exceeded. The microprocessor 30 further initiates the startup signal 32 to the locomotive engine 36 when the second pressure is less than the minimum automatic start threshold of the road pressure thresholds, or upon exceeding the maximum time duration threshold of the road mode thresholds during an automatic stop in the road mode 20.

Figure 3:
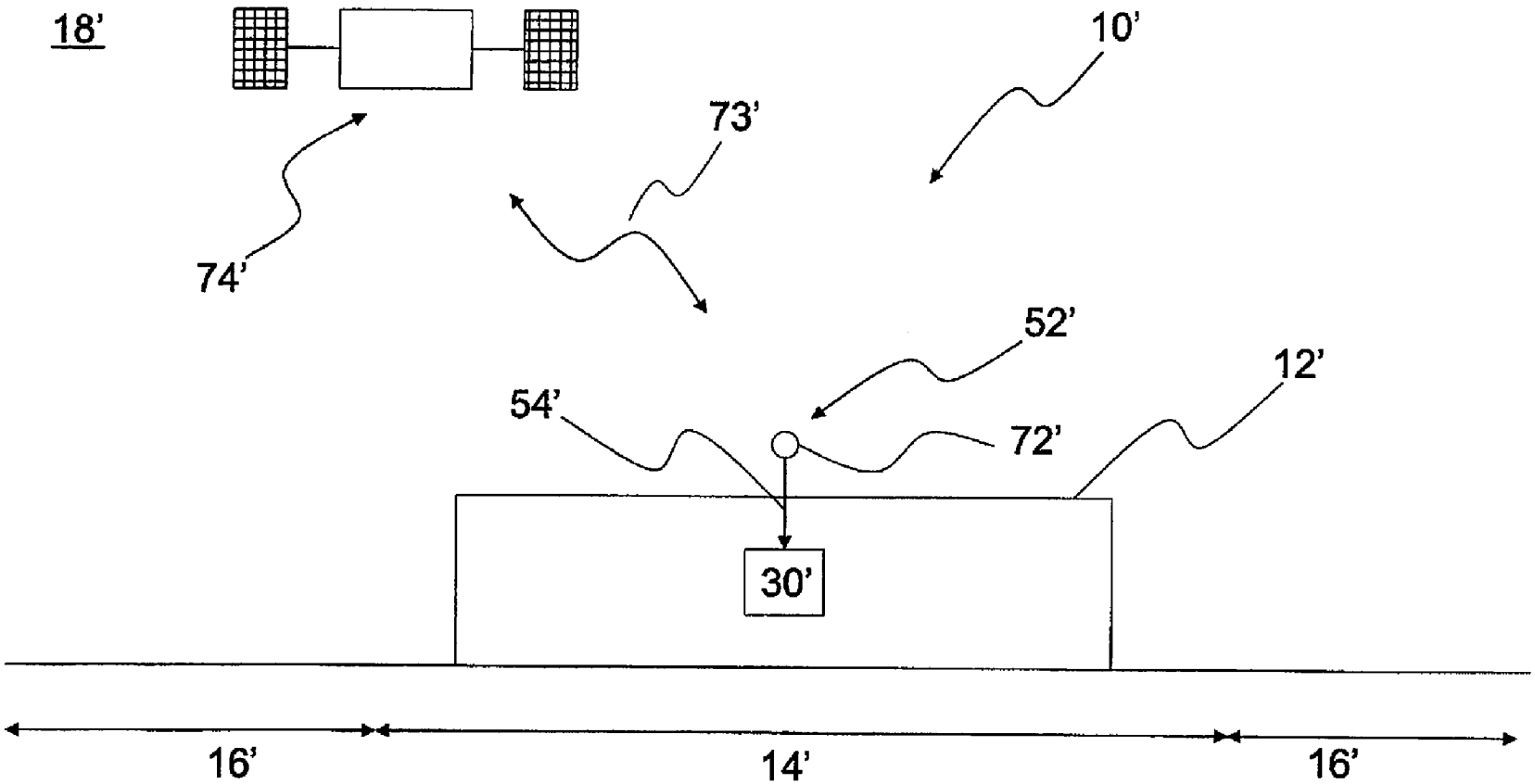
FIG. 3 is a schematic diagram of one embodiment of a convertible system in a yard mode.
Figure 4:
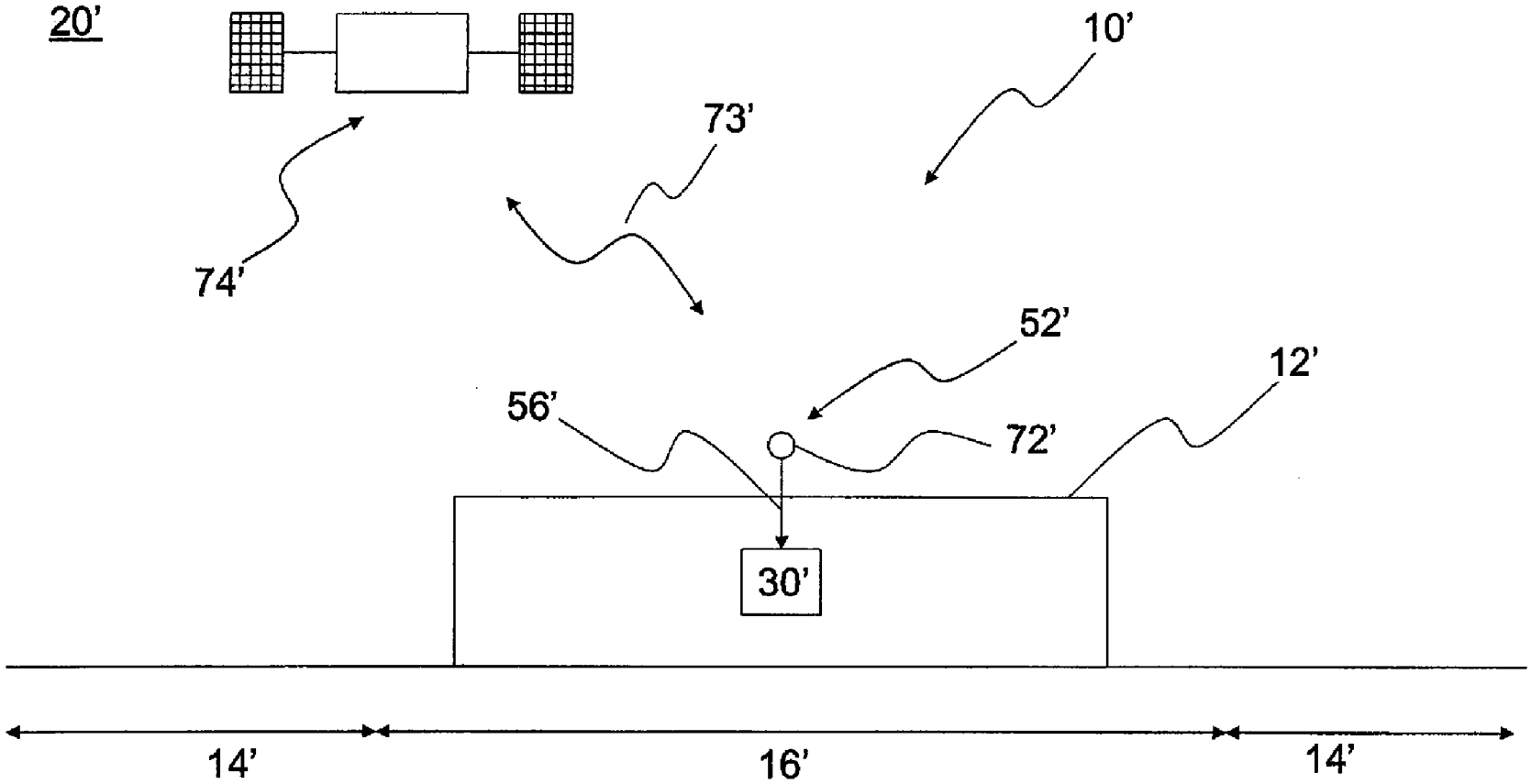
FIG. 4 is a schematic diagram of the convertible system of FIG. 3 in a road mode.

FIGS. 3 and 4 illustrate another embodiment of a convertible system 10' for controlling automatic starts and automatic stops of a locomotive engine. The convertible system 10' includes a software switch 52' coupled to the microprocessor 30' to respectively switch the convertible system 10' between the yard mode 18' (FIG. 3) and the road mode 20' (FIG. 4). The software switch 52' includes a transceiver 72' responsive with a global positioning system (GPS) 74' to determine that the locomotive is in a yard region 14' or a road region 16'. The transceiver 72' may receive a position information signal 73' from the GPS 74', and the microprocessor 30' may utilize the position information signal 73' to determine whether the locomotive 12' is in a yard region 14' or a road region 16', such as using stored yard/road region designation information for particular locomotive positions, for example. Upon determining that the locomotive is in a yard region 14' or a road region 16', a respective yard signal 54' (FIG. 3) or a road signal 56' (FIG. 4) is sent to the microprocessor 30' to switch the convertible system 10' between the respective yard mode 18' (FIG. 3) and road mode 20' (FIG. 4). Accordingly, the software switch 52' is a function of the software of the microprocessor 30', based upon the locomotive 12' GPS position. Those other elements of the convertible system 10' not discussed herein, are similar to those elements of the convertible system 10 discussed above, with prime notation, and require no further discussion herein.

Figure 5:
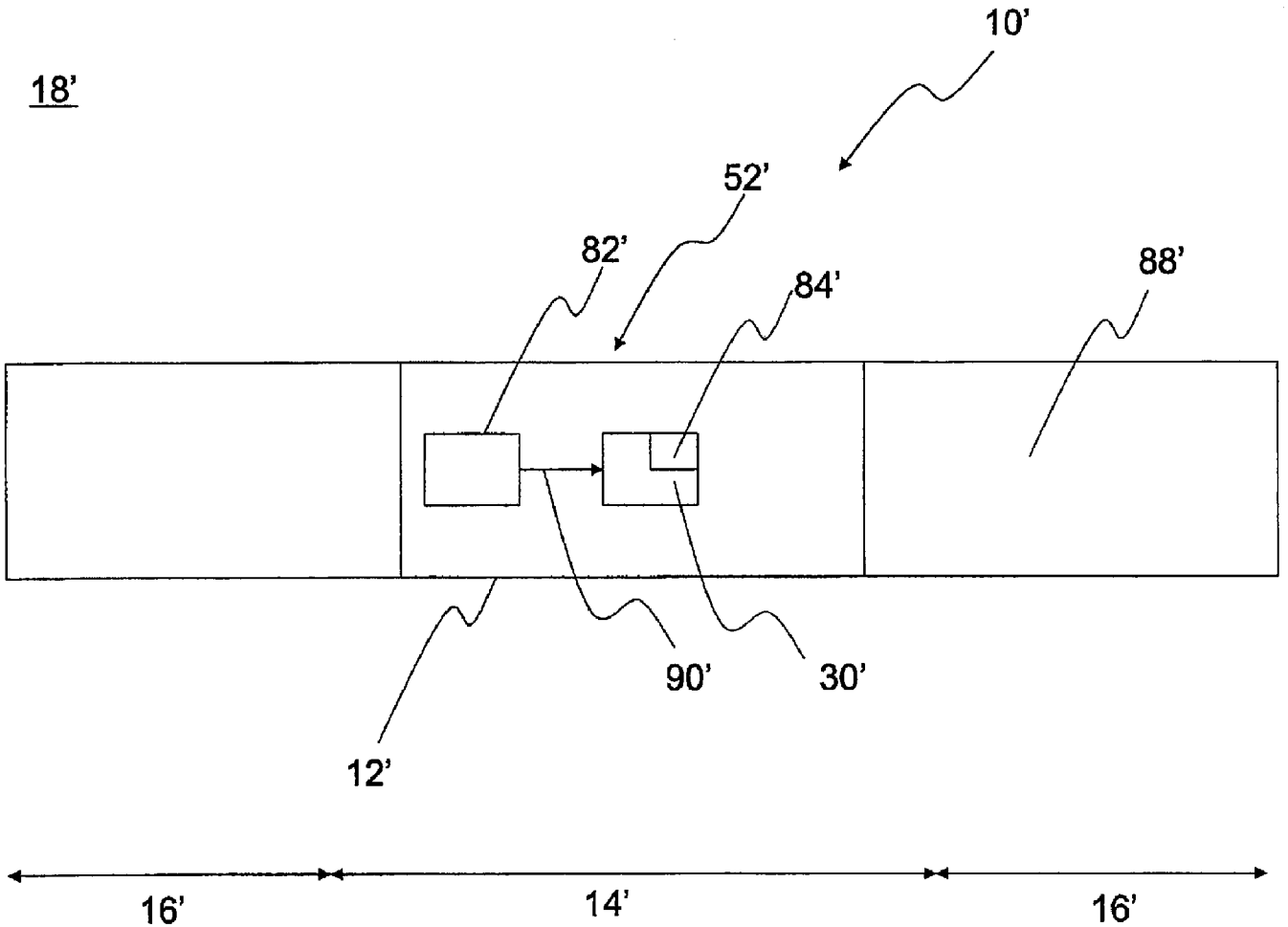
FIG. 5 is a schematic diagram of one embodiment of a convertible system in a yard mode.

FIG. 5 illustrates an exemplary embodiment of a convertible system 10' for controlling automatic starts and automatic stops of a locomotive engine. The convertible system 10' includes a software switch 52' to switch the convertible system 10 between the yard mode 18' and the road mode 20'. As illustrated in FIG. 5, the software switch 52' includes a position determining device 82' coupled to the microprocessor 30', and an internal memory 84' included within the microprocessor 30' to store predetermined road region and predetermined yard region designations along a locomotive path of travel 88'. While the locomotive 12' travels along the locomotive path of travel 88', the microprocessor 30' compares locomotive location information from the position determining device 82' with predetermined region information from the internal memory 84' to determine a present locomotive region from either the yard region 14' or the road region 16' for respectively switching the convertible system 10' between the yard mode 18' and road mode 20'. Accordingly, the software of the microprocessor 30' switches the convertible system 10' between the yard mode 18' and road mode 18', based upon the locomotive 12' position along the locomotive path of travel 88'. The position determining device may be an internal device, such as coupled to a mileage odometer, for example, which relays locomotive location information relative to fixed points along the path of travel 88", such relative to an initial start point, and the predetermined region information may determine the present locomotive region based on such relative locomotive location information. For example, in an exemplary embodiment, the predetermined region information may include that the first two miles of the locomotive path of travel from an initial start point are in a road region, while the remaining one-half mile of the locomotive path of travel is in a yard region.

The convertible system 10 may be located on the driver's console of the locomotive 12, or any location with driver access, such as adjacent to the engine control panel, for example. Although FIGS. 1-4 illustrate the convertible system in one of a yard mode or road mode based on the locomotive being in one of a respective yard region or road region, the convertible system may be adapted to include other modes of operation based on the locomotive being in other regions necessitating regulation of the automatic starts and stops with respective stored pressure thresholds and time data thresholds for automatic stops, for example.

Figure 6:
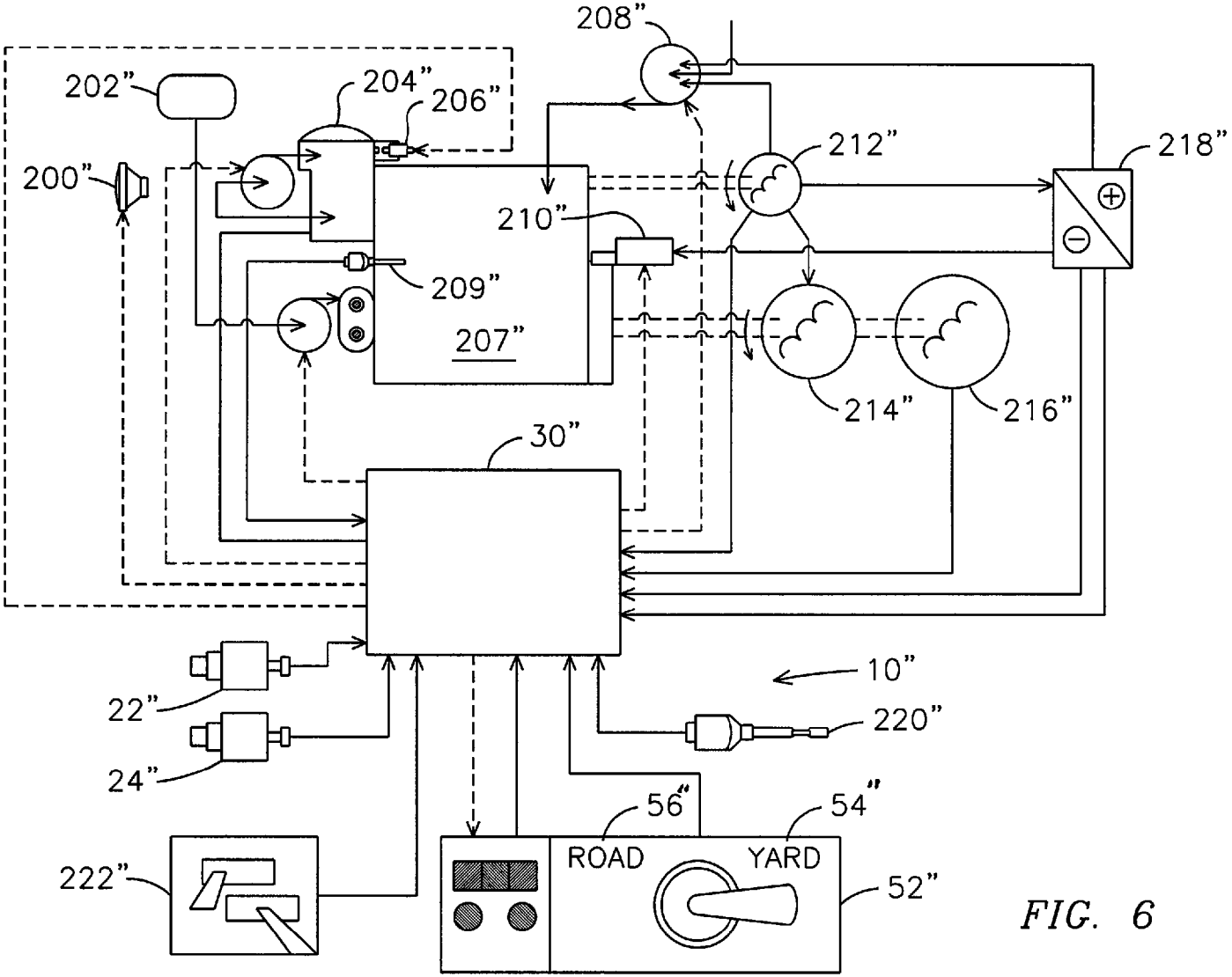
FIG. 6 is an exemplary embodiment of a convertible system.

Upon receiving a yard signal 54 or road signal 56, the microprocessor 30 sets the parameters of several locomotive devices and systems to a respective set of yard parameters or road parameters, based on the convertible system 10 respectively entering the yard mode or road mode. An exemplary embodiment of one set of yard parameters and road parameters are listed in FIG. 8 for an exemplary embodiment of a convertible system 100" illustrated in FIG. 6. The convertible system 10" includes a microprocessor 30", which may be a BrightStar™ Microprocessor control system, for example. Additionally, the convertible system 10" is illustratively coupled to several devices, including a CRBL 200", water tank 202", governor 204", a governor resist solenoid 206", engine 207", engine water thermometer 209", fuel pump 208", starter motor 210", auxiliary generator 212", alternators 214",216", battery 218", ambient air thermometer 220" and a throttle reverser 222". For example, upon entering the yard mode, the microprocessor 30" sets the battery 218" maximum current for permitting an automatic stop at 100 A.

Figure 7:
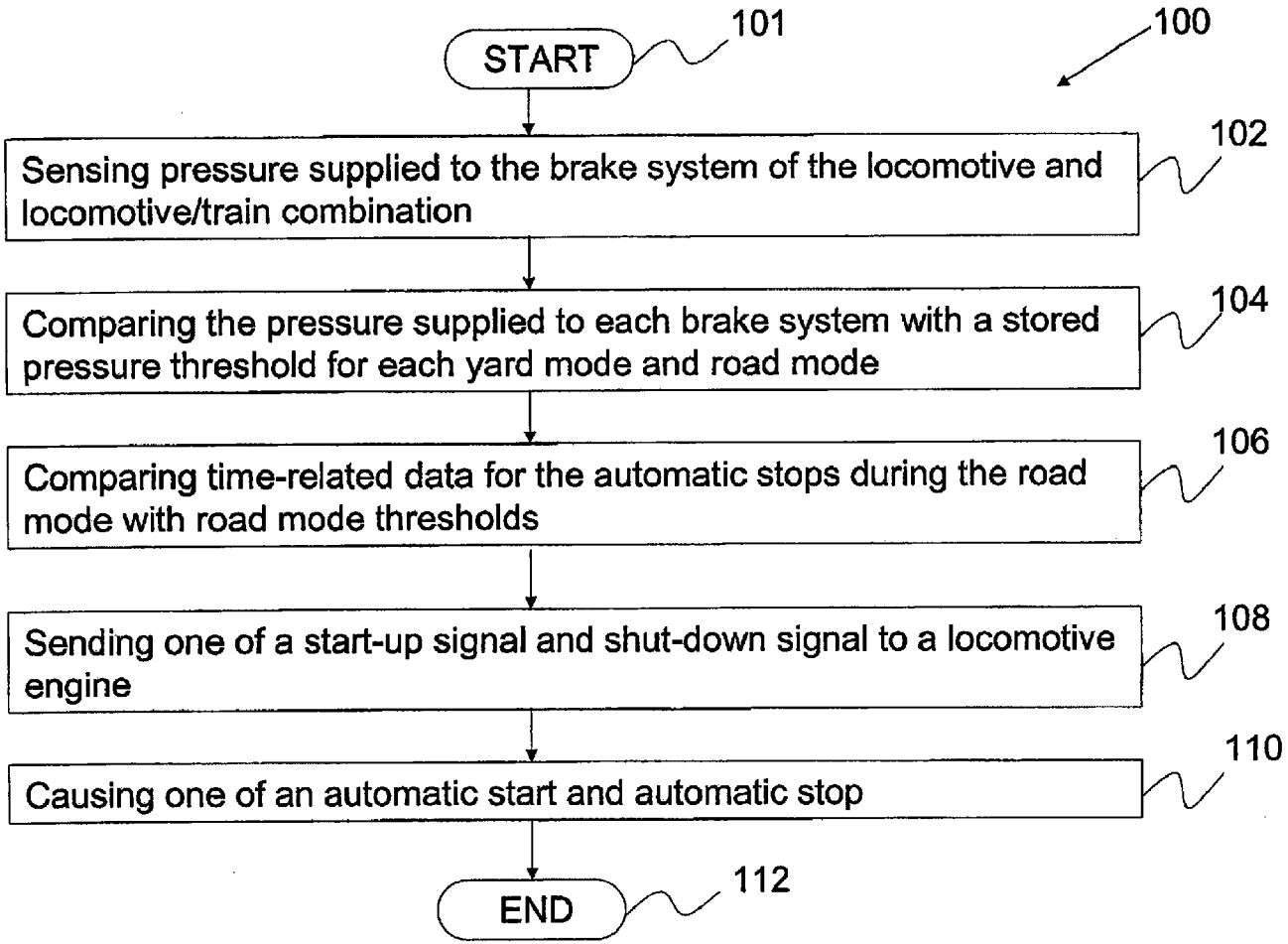
FIG. 7 is a flow chart illustrating an embodiment of a method for the system shown in FIG. 1

FIG. 7 illustrates an embodiment of a method 100 for controlling automatic starts and automatic stops of a locomotive engine 36. The locomotive 12 is used in one of a yard region 14 and road region 16. The method 100 is switchable between a yard mode 18 and a road mode 20 based on respectively using the locomotive 12 in the yard region 14 and the road region 16. The method 100 begins (block 101) by sensing (block 102) a pressure respectively supplied to a locomotive brake system 26 and a locomotive and train combination brake system 28. The method 100 then compares (block 104) the pressure supplied to each brake system 26,28 with a plurality of stored pressure thresholds for each yard mode 18 and road mode 20. The method 100 subsequently compares (block 106) time-related data for the automatic stops during the road mode 20 with a plurality of road mode thresholds. The method subsequently sends (block 108) a respective start up signal 32 or shut down signal 34 to a locomotive engine 36. Each respective start up signal 32 and shut down signal 34 is based on comparing (block 104) the pressure supplied to each brake system 26,28 with a plurality of stored pressure thresholds and comparing (block 106) the time-related data for the automatic stops during the road mode 20 with a plurality of road mode thresholds. The method further includes causing (block 110) an automatic start or an automatic stop based on sending (block 108) a respective start up signal 32 or a shut down signal 34 to the locomotive engine 36.

Additionally, the method may further include coupling a manual switch to a microprocessor to respectively switch the convertible system between the yard mode and road mode.

The step of sensing a pressure supplied to a locomotive brake system may further include sensing a first pressure respectively supplied to a locomotive brake system and sensing a second pressure sensor respectively supplied to a locomotive and train combination brake system. Additionally, the method may further include moving the manual switch to one of a yard position and a road position, generating a respective yard signal and a road signal from the manual switch upon moving the manual switch to one of a yard position and a road position, and switching the method to one of the yard mode and road mode based upon the microprocessor receiving a respective yard signal and road signal.

Upon switching the method to the yard mode, comparing the pressure supplied to each brake system with each stored pressure threshold may include comparing the first pressure of the locomotive brake system with at least one yard pressure threshold of the stored pressure thresholds. Additionally, upon switching the method to the road mode, comparing the pressure supplied to each brake system with each stored pressure threshold may include comparing the second pressure of the locomotive and train combination brake system with at least one road pressure threshold of the stored pressure thresholds.

Based on the foregoing specification, an exemplary embodiment of the invention may be implemented using computer programming or engineering techniques including computer software, firmware, hardware or any combination or subset thereof, wherein the technical effect is to control automatic starts and automatic stops of a locomotive engine. Any such resulting program, having computer-readable code means, may be embodied or provided within one or more computer-readable media, thereby making a computer program product, i.e., an article of manufacture, according to an embodiment of the invention. The computer readable media may be, for instance, a fixed (hard) drive, diskette, optical disk, magnetic tape, semiconductor memory such as read-only memory (ROM), etc., or any transmitting/receiving medium such as the Internet or other communication network or link. The article of manufacture containing the computer code may be made and/or used by executing the code directly from one medium, by copying the code from one medium to another medium, or by transmitting the code over a network.

One skilled in the art of computer science will easily be able to combine the software created as described with appropriate general purpose or special purpose computer hardware, such as a microprocessor, to create a computer system or computer sub-system embodying the method of one embodiment of the invention. An apparatus for making, using or selling one embodiment of the invention may be one or more processing systems including, but not limited to, a central processing unit (CPU), memory, storage devices, communication links and devices, servers, I/O devices, or any sub-components of one or more processing systems, including software, firmware, hardware or any combination or subset thereof, which embody an exemplary embodiment of the invention.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A convertible system for controlling automatic starts and automatic stops of a locomotive engine, comprising:

the locomotive being used in one of a yard region and road region, said convertible system being switchable between a yard mode and a road mode based upon said locomotive being respectively used in said yard region and said road region;

at least one pressure sensor for sensing respective pressure supplied to at least one brake system of said locomotive and at least one brake system of a locomotive and train combination;

a microprocessor coupled to each pressure sensor, each respective brake system and a locomotive engine, said microprocessor for causing one of said automatic start and automatic stop based upon sending one of a respective start up signal and a shut down signal to said locomotive engine; each of said respective start up signal and shut down signal based upon comparing said pressure received from said at least one pressure sensor and supplied to at least one brake system with at least one stored pressure threshold for each of said yard mode and said road mode, and further based upon comparing time-related data for said automatic stops during said road mode with at least one road mode threshold; and a switch coupled to said microprocessor for respectively switching said convertible system between said yard mode and said road mode.

2. The convertible system for controlling automatic starts and automatic stops of a locomotive engine according to claim 1, wherein said at least one pressure sensor comprises a first pressure sensor for sensing a first pressure supplied to a locomotive brake system, and a second pressure sensor for sensing a second pressure supplied to a locomotive and train combination brake system.

3. The convertible system for controlling automatic starts and automatic stops of a locomotive engine according to claim 2, wherein said microprocessor is responsive to one of a yard signal and a road signal from said manual switch based upon said manual switch moving to one of a respective yard position and road position, wherein upon said microprocessor receiving said yard signal, said microprocessor compares said first pressure of said locomotive brake system with at least one yard pressure threshold of said at least one stored pressure threshold; and wherein upon said microprocessor receiving said road signal, said microprocessor compares said second pressure of said locomotive and train combination brake system with at least one road pressure threshold of said at least one stored pressure threshold.

4. The convertible system for controlling automatic starts and automatic stops of a locomotive engine according to claim 3, wherein said at least one yard pressure threshold and said at least one road pressure threshold respectively comprise at least one automatic stop threshold including a minimum automatic stop threshold, and at least one automatic start threshold including a minimum automatic start threshold; and wherein said at least one road mode threshold comprises a maximum time duration threshold for each automatic stop in said road mode and a maximum number of automatic stops threshold within a predetermined time in said road mode.

5. The convertible system for controlling automatic starts and automatic stops of a locomotive engine according to claim 4, wherein upon said microprocessor receiving said yard signal, said microprocessor initiates said shut down signal to said locomotive engine when said first pressure is greater than said at least one minimum automatic stop threshold of said at least one yard pressure threshold, and wherein said microprocessor initiates said startup signal to said locomotive engine when said first pressure is less than said at least one minimum automatic start threshold of said at least one yard pressure threshold.

6. The convertible system for controlling automatic starts and automatic stops of a locomotive engine according to claim 4, wherein upon said microprocessor receiving said road signal, said microprocessor initiates said shut down signal to said locomotive engine when said second pressure is greater than said at least one minimum automatic stop threshold of said at least one road pressure threshold, unless said maximum number of automatic stops within a predetermined time threshold of said at least one road mode threshold has been exceeded; and wherein said microprocessor initiates said startup signal to said locomotive engine when said second pressure is less than said at least one minimum automatic start threshold of said at least one road pressure threshold, or upon said maximum time duration threshold of said at least one road mode threshold being exceeded during an automatic stop.

7. The convertible system for controlling automatic starts and automatic stops of a locomotive engine according to claim 1, wherein the switch is a software switch coupled to said microprocessor for switching said convertible system between said yard mode and said road mode, said software switch comprising a transceiver responsive with a global positioning system (GPS) for determining that said locomotive is in one of a yard region and a road region for sending a respective yard signal and road signal to said microprocessor to switch said convertible system between said yard mode and said road mode.

8. The convertible system for controlling automatic starts and automatic stops of a locomotive engine according to claim 1, wherein the switch is a software switch for switching said convertible system between said yard mode and said road mode, said software switch comprising a position determining device coupled to the microprocessor, said microprocessor including an internal memory for storing predetermined road region and predetermined yard region designations along a locomotive path of travel, wherein during said locomotive traveling along said locomotive path of travel, said microprocessor compares locomotive location information from said position determining device with predetermined region information from said internal memory for determining a present locomotive region from one of said road region and said yard region for switching said convertible system between said yard mode and road mode.

9. A method for controlling automatic starts and automatic stops of a locomotive engine, comprising:

using the locomotive in one of a yard region and road region;

switching said method between a yard mode and a road mode based upon said locomotive being respectively used in said yard region and said road region;

sensing at least one pressure respectively supplied to at least one brake system of said locomotive and at least one brake system of a locomotive and train combination;

comparing said pressure supplied to each of said at least one brake system with at least one stored pressure threshold for each of said yard mode and said road mode;

comparing time-related data for said automatic stops during said road mode with at least one road mode threshold;

sending one of a respective start up signal and a shut down signal to a locomotive engine, each of said respective start up signal and shut down signal based upon said comparing said pressure supplied to at least one brake system with at least one stored pressure threshold and said comparing time-related data for said automatic stops during said road mode with at least one road mode threshold;

causing one of said automatic start and automatic stop based upon said sending one of a respective start up signal and a shut down signal to a locomotive engine; and wherein the convertible system is switched between said yard mode and road mode with a switch coupled to the microprocessor.

10. The method for controlling automatic starts and automatic stops of a locomotive engine according to claim 9, wherein sensing at least one pressure further comprises sensing a first pressure respectively supplied to a locomotive brake system and sensing a second pressure sensor respectively supplied to a locomotive and train combination brake system.

11. The method for controlling automatic starts and automatic stops of a locomotive engine according to claim 10, further comprising:

moving said switch to one of a yard position and a road position;

generating a respective yard signal and a road signal from said switch upon said moving said switch to one of a yard position and a road position; and switching said method to one of said yard mode and road mode based upon said microprocessor receiving a respective yard signal and road signal.

12. The method for controlling automatic starts and automatic stops of a locomotive engine according to claim 11, wherein upon switching said method to said yard mode, said comparing said pressure supplied to at least one brake system with at least one stored pressure threshold comprises comparing said first pressure of said locomotive brake system with at least one yard pressure threshold of said at least one stored pressure threshold, and wherein upon switching said method to said road mode, said comparing said pressure supplied to at least one brake system with at least one stored pressure threshold comprises comparing said second pressure of said locomotive and train combination brake system with at least one road pressure threshold of said at least one stored pressure threshold.

13. The method for controlling automatic starts and automatic stops of a locomotive engine according to claim 12, wherein said at least one yard pressure threshold and said at least one road pressure threshold respectively comprise at least one automatic stop threshold including a minimum automatic stop threshold, and at least one automatic start threshold including a minimum automatic start threshold; and wherein said at least one road mode threshold comprises a maximum time duration threshold for each automatic stop in said road mode and a maximum number of automatic stops threshold within a predetermined time in said road mode.

14. The method for controlling automatic starts and automatic stops of a locomotive engine according to claim 13, wherein upon switching said method to said yard mode, said sending said shut down signal is based upon comparing said first pressure of said locomotive brake system with at least one yard pressure threshold, said comparing said first pressure of said locomotive brake system with at least one yard pressure threshold comprises determining whether said first pressure is greater than said at least one minimum automatic stop threshold of said at least one yard pressure threshold, and said sending said start up signal is based upon comparing said first pressure of said locomotive brake system with at least one yard pressure threshold, said comparing said first pressure of said locomotive brake system with at least one yard pressure threshold comprises determining whether said first pressure is less than said at least one minimum automatic start threshold of said at least one yard pressure threshold.

15. The method for controlling automatic starts and automatic stops of a locomotive engine according to claim 13, wherein upon switching said method to said road mode, said sending said shut down signal is based upon comparing said second pressure of said locomotive and train combination brake system with at least one road pressure threshold, said comparing said second pressure of said locomotive and train combination brake system with at least one road pressure threshold comprises determining whether said second pressure is greater than said at least one minimum automatic stop threshold of said at least one road pressure threshold, unless said maximum number of automatic stops within a predetermined time threshold of said at least one road mode threshold has been exceeded; and said sending said start up signal is based upon comparing said second pressure of said locomotive and train combination brake system with at least one road pressure threshold, said comparing said second pressure of said locomotive and train combination brake system with at least one road pressure threshold comprises determining whether second pressure is less than said at least one minimum automatic start threshold of said at least one road pressure threshold, or upon said maximum time duration threshold of said at least one road mode threshold being exceeded during an automatic stop.

16. Computer readable media containing program instructions for a method for controlling automatic starts and automatic stops of a locomotive engine, the locomotive being used in one of a yard region and road region, said method being switchable between a yard mode and a road mode based upon said locomotive being respectively used in said yard region and said road region, said method comprising sensing at least one pressure respectively supplied to at least one brake system of said locomotive and at least one brake system of a locomotive and train combination, the computer readable media comprising:

a computer program code for comparing said pressure supplied to at least one brake system with at least one stored pressure threshold for each of said yard mode and said road mode;

a computer program code for comparing time-related data for said automatic stops during said road mode with at least one road mode threshold;

a computer program code for sending one of a respective start up signal and a shut down signal to a locomotive engine, each of said computer program code for sending one of a respective start up signal and shut down signal based upon said computer program code for comparing said pressure supplied to at least one brake system with at least one stored pressure threshold and said computer program code for comparing time-related data for said automatic stops during said road mode with at least one road mode threshold; and a computer program code for causing one of said automatic start and automatic stop based upon said computer program code for sending one of a respective start up signal and a shut down signal to a locomotive engine.

17. A system for controlling automatic stops and automatic starts of an engine of a locomotive, said locomotive positioned in one of a first region and a second region, said system comprising:

a switch configured to change a mode of the system into a first mode when the locomotive enters the first region and into a second mode when the locomotive enters the second region;

a sensor configured to measure an operating parameter of the locomotive;

a processor coupled to the sensor to compare the measured operating parameter with a first automatic stop threshold and a first automatic start threshold when the system is in the first mode, to initiate one of a respective automatic stop and automatic start of the locomotive engine in the first region, and to compare the measured operating parameter with a second automatic stop threshold and a second automatic start threshold when the system is in the second mode, to initiate one of a respective automatic stop and automatic start of the locomotive engine in the second region.

* * * * *